United States Patent [19]

Nitta

[11] 4,073,612

[45] Feb. 14, 1978

[54] DISPOSABLE CIGARETTE GAS LIGHTER

[75] Inventor: Tomio Nitta, Yokohama, Japan

[73] Assignee: Tokai Seiki Co., Ltd., Yokohama, Japan

[21] Appl. No.: 667,534

[22] Filed: Mar. 17, 1976

[30] Foreign Application Priority Data

| | | |
|---|---|---|
| Mar. 2, 1976 | Japan | 51-24510[U] |
| Jan. 2, 1976 | Japan | 51-56[U] |

[51] Int. Cl.[2] ..... F23Q 2/32

[52] U.S. Cl. ..... 431/126; 431/344; 40/10 R; 40/373; 40/622; D27/36; D27/42

[58] Field of Search ..... D27/36, 42; 431/344, 431/126, 253, 254; 206/459; 220/82 A, 82 R; 40/63 A, 63 R, 10 R, 124.2, 10 C, 158 R, 10 D, 159, 143

[56] References Cited

U.S. PATENT DOCUMENTS

| | | | |
|---|---|---|---|
| 2,052,689 | 9/1936 | Aronson | 431/126 |
| 2,611,202 | 9/1952 | Lipic | 431/126 |
| 2,759,280 | 8/1956 | Schlage | 40/10 R |
| 2,781,594 | 2/1957 | Stupell | 40/10 R |
| 3,204,356 | 9/1965 | Close et al. | 40/10 R |
| 3,769,725 | 11/1973 | Stewart, Jr. | 40/10 R |

*Primary Examiner*—John J. Camby
*Assistant Examiner*—Henry C. Yuen
*Attorney, Agent, or Firm*—Gerald J. Ferguson, Jr.; Joseph J. Baker

[57] ABSTRACT

A disposable cigarette gas lighter employing a plastic gas tank is provided on the face of the gas tank with a printed sheet carrying thereon publicity information. The gas tank is provided with a recess to receive the printed sheet and a plastic lens is attached thereover. Otherwise, the plastic lens is provided on the back surface thereof with a recess to receive the printed sheet. The plastic lens is formed as a cylindrical positive lens.

10 Claims, 4 Drawing Figures

DISPOSABLE CIGARETTE GAS LIGHTER

BACKGROUND OF THE INVENTION

1. Field of the Invention

This invention relates to a gas fueled lighter, and more particularly to a disposable cigarette gas lighter having a plastic body carrying a printed sheet for publicity or advertisement.

2. Description of the Prior Art

Disposable cigarette gas lighters containing liquefied gas in a plastic tank as well known. Since this kind of gas lighter is very cheap, the cost of lighting a cigarette with such a lighter is as low as a third of the cost of using a match. Therefore, this kind of gas lighter has been widely used instead of matches. However, disposable gas lighters are inferior to matches in that they do not function as publicity or advertising media. Because they do not serve as advertising media, the use of disposable gas lighters is limited.

It has been known in the art to print or stamp characters or figures on the surface of the plastic tank of disposable gas lighters by means of silk print or hot stamp. However, the print or stamp provided on the plastic gas tank by these means is poor in color and sharpness, and accordingly, is not sufficiently effective as publicity or advertisement. Further, these methods of printing or stamping are disadvantageous in that the plastic gas tank is subjected to a high temperature and the plastic material of the tank is apt to be changed in quality. In addition, it is difficult to make a molded plastic tank or body having a flat surface suitable to be printed. Therefore, it is very difficult to print or stamp characters or figures for publicity or advertisement directly on the surface of the lighter body. Furthermore, the silk print or hot stamp is disadvantageous in that the gas lighter itself is damaged and must be thrown away if the printing or stamping is defective.

In addition, this kind of gas lighter is always carried and is handled in the palm when it is used to light a cigarette. Therefore, if simply a label is attached to the body thereof, the label is apt to be peeled off or damaged.

It has also been known in the art to make the lighter body in double wall form so as to consist of an inner cylindrical body serving as a gas tank an an outer cylindrical transparent wall serving as a cover and to insert a printed paper between the tank and the outer wall. This kind of lighter is disadvantageous in that the manufacturing cost thereof is high and the printed advertisement is hard to see from outside. Further, it is impossible to change the paper.

SUMMARY OF THE INVENTION

In view of the above described defects inherent in the conventional disposable gas lighter, the primary object of the present invention is to provide a disposable gas lighter which carries on the body thereof publicity printed in beautiful color and excellent sharpness.

Another object of the present invention is to provide a disposable gas lighter which has printed publicity medium which is not easily peeled off or damaged.

Still another object of the present invention is to provide a disposable gas lighter which carries a printed publicity medium which can be attached to the lighter body after the lighter itself is completed.

A further object of the present invention is to provide a disposable gas lighter which carries printed publicity which is easy to see from the outside.

A still further object of the present invention is to provide a disposable gas lighter which carries a printed publicity medium which can be manufactured at a low cost.

The disposable gas lighter in accordance with the present invention is characterized in that a sheet bearing printed publicity or advertisement is attached to a face of the plastic gas tank with a transparent plastic lens attached thereover. The plastic lens may be fixed to the surface of the gas tank or may be removable mounted thereto with the printed sheet interposed between the wall of the gas tank and the plastic lens. The surface of the plastic gas tank may be provided with a recess into which the plastic lens is inserted with the printed sheet interposed between the recess and the plastic lens. Otherwise, the plastic lens may be provided on the back surface thereof with a recess to receive the printed sheet therein, and the plastic lens with the printed sheet held therein may be attached to the surface of the gas tank.

Since paper is the most suitable for printing fine and colorful information, the printed sheet is preferably a piece of paper printed with information such as characters and figures for publicity or advertisement. In addition, paper is advantageous from point of economy as well.

The printed sheet bearing publicity information is protected by the plastic lens attached thereover.

DESCRIPTION OF THE PREFERRED EMBODIMENTS

Figure 1:
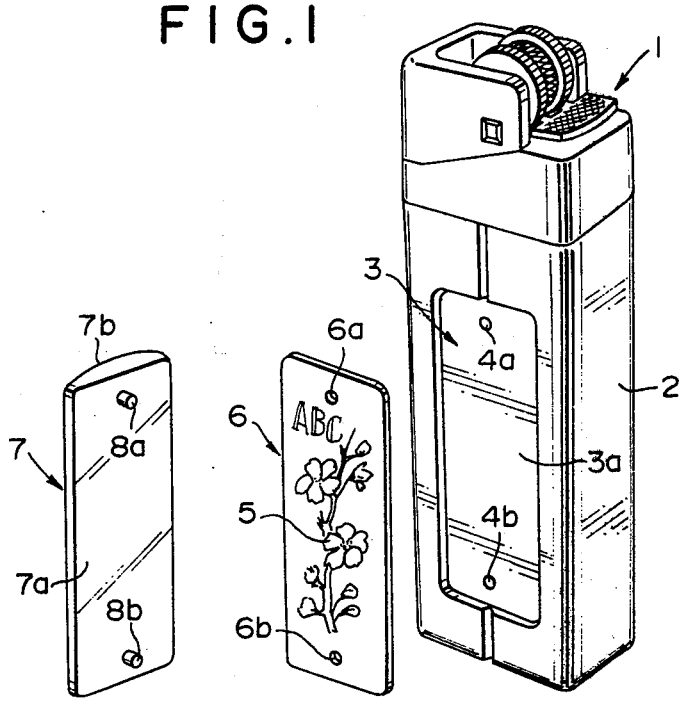
FIG. 1 is an exploded perspective view of a disposable gas lighter in accordance with an embodiment of the present invention.
Figure 2:
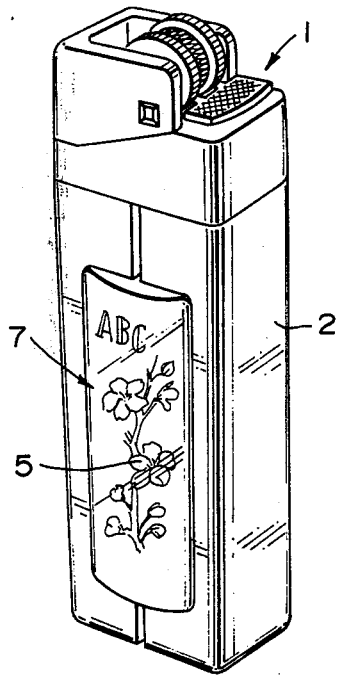
FIG. 2 is a perspective completely assembly view of the gas lighter of the embodiment of the present invention as shown in FIG. 1.

A preferred embodiment of the present invention will now be described in detail with reference to FIGS. 1 and 2. A plastic gas tank 2 of a disposable gas lighter 1 is provided on the front face 2*a* thereof with a flat recess 3. The recess 3 is formed when the plastic gas tank 2 is molded. The shape of the recess 3 is illustrated to be rectangular in this embodiment. However, the shape thereof is not limited to rectangular. For instance, it may be oval, square or circular. The recess 3 has a flat bottom surface 3*a* and a pair of holes 4*a* and 4*b* formed on the bottom surface 3*a* at the upper and lower portions thereof. The recess 3 may be provided on any face of the gas tank 2. Further, more than one recess may be provided on the gas tank 2. For instance, both the front and rear faces of the gas tank 2 may be provided with recesses.

A printed sheet 6 carrying thereon publicity information 5 such as characters and figures is placed in the recess 3 and covered with a transparent plastic lens 7. The printed sheet 6 should preferably be made of paper, since the paper is the most suitable for colorful printing with high sharpness. The printed sheet has a pair of perforations 6*a* and 6*b* at positions aligned with said holes 4*a* and 4*b* on the bottom surface of the gas tank. The shape of the printed sheet 6 is identical with the shape of the recess 3 so that the sheet 6 will be accommodated within the recess, though this is not always necessary. The plastic lens 7 has a flat back surface 7*a* to press the printed sheet 6 against the flat bottom surface 3*a* of the recess 3. The plastic lens 7 is provided on the flat back surface 7*a* thereof with a pair of projections 8*a* and 8*b* in the upper and lower portions thereof to be engaged with said holes 4*a* and 4*b* formed on the bottom surface 3*a* of the recess 3. The projections 8*a* and 8*b* extend through the perforations 6*a* and 6*b* of the printed sheet 6 and are mated with the holes 4*a* and 4*b* when the plastic lens 7 is fixed to the gas tank 2 with the printed sheet 6 interposed between the lens 7 and the tank 2. The front surface 7*b* of the plastic lens 7 should preferably be curved forwardly to form a cylindrical positive lens. However, the front surface 7*b* of the plastic lens 7 may be flat. When it is curved, the printed publicity information 5 on the sheet 6 can be viewed in enlarged scale from the outside. The plastic lens 7 is made of transparent material such as acrylic resins.

The plastic lens 7 may be firmly fixed to the plastic gas tank 2 welding or by use of adhesive, but may be removably mounted thereto by friction engagement between the projections 8*a* and 8*b* and the holes 4*a* and 4*b*, or between the side edges of the plastic lens 7 and the side walls of the recess 3. In the case that the plastic lens 7 is removably mounted to the recess 3 of the gas tank 2 of the gas lighter 1, the printed sheet 6 can be changed even after the gas lighter with the publicity information is completed.

In the above described embodiment, the plastic lens 7 is provided with projections 8*a* and 8*b* to be engaged with the holes 4*a* and 4*b* in the recess 3. However, it should be noted that these projections 8*a* and 8*b* and holes 4*a* and 4*b* and accordingly the perforations 6*a* and 6*b* of the printed sheet 6 can be omitted. Particularly, when the shape of the printed sheet 6 and the plastic lens 7 is identical with that of the recess 3, these means for positioning and fixing the sheet 6 and the plastic lens 7 in the recess can be omitted. In this case, the plastic lens 7 is adhered to or engaged with the recess 3 at the side edges thereof. It is also possible to adhere the printed sheet 6 to the bottom surface 3*a* of the recess 3 and further adhere the plastic lens 7 to the surface of the printed sheet 6.

The depth of the recess 3 is larger than the thickness of the printed sheet 6 so that the printed sheet 6 may be completely protected by the covering plastic lens 7. The plastic lens 7 serves not only to cause the printed information 5 to be viewed in enlarged scale, but also to protect the printed sheet 6 from external mechanical and chemical influences.

In the above described embodiment, the shape of the plastic lens 7 is identical with the recess 3. However, the plastic lens 7 may be larger than the recess. In this case, the depth of the recess is made equal to the thickness of the printed sheet and the plastic lens 7 is directly fixed to the surface 2*a* of the gas tank 2 covering the printed sheet 6 therebeneath.

In the above described embodiment of the invention, a recess 3 is formed on the surface of the gas tank 2 and the plastic lens 7 is engaged with the recess 3. However, it is possible to form a recess on the back surface of the plastic lens to be attached to the tank 2 and to attach the lens directly to the surface of the tank 2 with a printed sheet retained in the recess on the back surface thereof. One example of such an embodiment will hereinbelow described in detail with reference to FIGS. 3 and 4.

Figure 3:
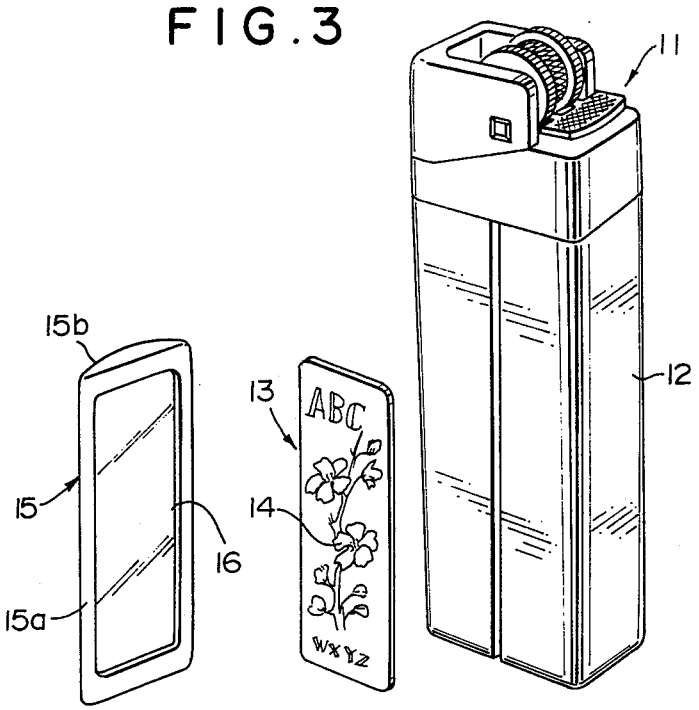
FIG. 3 is an exploded perspective view of a disposable gas lighter in accordance with another embodiment of the present invention.
Figure 4:
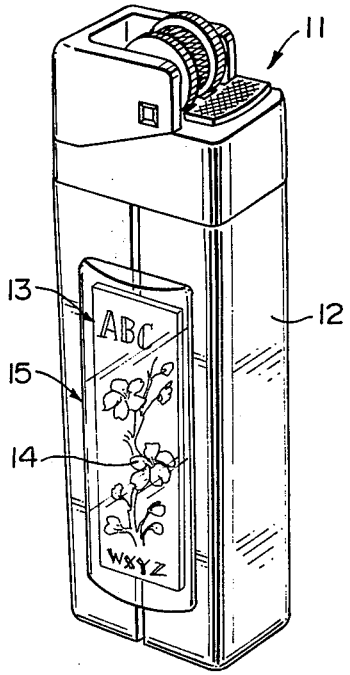
FIG. 4 is a perspective completely assembled view of the gas lighter of the embodiment as shown in FIG. 3.

Referring to FIGS. 3 and 4, a disposable cigarette gas lighter 11 having a plastic gas tank 12 is provided on the front face 12*a* thereof with a printed sheet 13 carrying printed thereon publicity information 14 such as characters and figures, the printed sheet being covered with a plastic lens 15. The plastic lens 15 has a recess 16 on the back surface 15*a* thereof. The recess 16 has a flat bottom surface 16*a*. The depth of the recess 16 is substantially equal to the thickness of the printed sheet 13. The shape of the recess 16 is substantially identical with that of the printed sheet 13, though this is not always necessary. The front surface 15*b* of the plastic lens 15 should preferably be curved forwardly to form a cylindrical positive lens so that the publicity information 14 on the printed sheet 13 will be viewed in enlarged scale. The printed sheet 13 covered with the plastic lens 15 is protected thereby against various mechanical and chemical influences.

I claim:

1. A disposable cigarette gas lighter comprising a plastic gas tank containing therein a liquefied fuel gas, said gas tank having a recess on the surface thereof, lighting means mounted on said plastic gas tank, a printed sheet having printed thereon publicity information, said printed sheet being disposed in the recess, and a transparent plastic lens disposed within said recess and directly attached to the gas tank over the printed sheet to hold and protect the printed sheet, wherein said plastic lens has a projection intergrally fixed thereof on the back surface thereof, and said recess is provided with a hole to receive said projection of said lens, wherein said printed sheet is provided with a perforation to allow said projection of said lens to extend therethrough, said plastic lens has a front surface forwardly curved to form a positive cylindrical lens.

2. A disposable cigarette gas lighter as defined in claim 1 wherein said recess has side edges and said plastic lens is engaged with the side edges of said recess.

3. A disposable cigarette gas lighter as defined in claim 1 wherein said plastic lens is removably mounted to the gas tank.

4. A disposable cigarette gas lighter as defined in claim 1 wherein said plastic lens has a pair of projections integrally fixed thereto on the back surface thereof in the upper and lower portions thereof, and said recess is provided with a pair of holes to receive said pair of projections.

5. A disposable cigarette gas lighter as defined in claim 4 wherein said printed sheet is provided with a pair of perforations to allow said projections to extend therethrough.

6. A disposable cigarette gas lighter as defined in claim 1 wherein said printed sheet is located at the center of a face of the gas tank.

7. A disposable cigarette gas lighter as defined in claim 6 wherein said printed sheet is rectangular.

8. A disposable cigarette gas lighter as defined in claim 6 wherein said printed sheet is oval.

9. A disposable cigarette gas lighter as defined in claim 6 wherein said printed sheet is circular.

10. A disposable cigarette gas lighter as defined in claim 1 wherein said printed sheet is made of paper.

* * * * *